US009394139B2

(12) United States Patent
Kugiya et al.

(10) Patent No.: US 9,394,139 B2
(45) Date of Patent: Jul. 19, 2016

(54) MULTI-CAR ELEVATOR AND CONTROLLING METHOD THEREFOR

(75) Inventors: Takuo Kugiya, Tokyo (JP); Masayuki Kakio, Tokyo (JP); Kiyoshi Funai, Tokyo (JP); Masafumi Iwata, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 505 days.

(21) Appl. No.: 13/981,140

(22) PCT Filed: Apr. 8, 2011

(86) PCT No.: PCT/JP2011/058905

§ 371 (c)(1),
(2), (4) Date: Jul. 23, 2013

(87) PCT Pub. No.: WO2012/137346

PCT Pub. Date: Oct. 11, 2012

(65) Prior Publication Data

US 2013/0299282 A1 Nov. 14, 2013

(51) Int. Cl.

| | |
|---|---|
| ***B66B 9/00*** | (2006.01) |
| ***B66B 1/32*** | (2006.01) |
| ***B66B 5/00*** | (2006.01) |

(52) U.S. Cl.

CPC ..... *B66B 1/32* (2013.01); *B66B 5/0031* (2013.01)

(58) Field of Classification Search

CPC ..... B66B 1/32; B66B 5/0031
USPC ..... 187/247, 380–388, 391, 393, 249, 314
See application file for complete search history.

(56) References Cited

U.S. PATENT DOCUMENTS

| | | | | |
|---|---|---|---|---|
| 5,663,538 | A * | 9/1997 | Sakita | B66B 1/2466 187/249 |
| 5,877,462 | A * | 3/1999 | Chenais | B66B 5/0031 187/249 |
| 6,802,395 | B1 * | 10/2004 | Helstrom | B66B 5/02 187/247 |

(Continued)

FOREIGN PATENT DOCUMENTS

| | | |
|---|---|---|
| JP | 2006 240798 | 9/2006 |
| JP | 2010 538948 | 12/2010 |
| KR | 10-2010-00631 21 | 6/2010 |

OTHER PUBLICATIONS

Korean Office Action issued Nov. 24, 2014, in Korea Patent Application No. 10-2013-7023854 (with English translation).

(Continued)

*Primary Examiner* — Anthony Salata
(74) *Attorney, Agent, or Firm* — Oblon, McClelland, Maier & Neustadt, L.L.P

(57) ABSTRACT

In a multi-car elevator, when two adjacent cars travel in a like direction, an elevator controlling apparatus: determines a shortest stopping position that is a stopping position at which a leading car stops in a shortest stopping distance from its present position; determines an estimated stopping position that is a stopping position of a trailing car if the trailing car is stopped urgently when the trailing car deviates from a speed change path for stopping using decelerating control by the elevator controlling apparatus from its present position and approaches the leading car; and controls a separating distance between the leading car and the trailing car such that the estimated stopping position is before the shortest stopping position.

7 Claims, 3 Drawing Sheets

(56) References Cited

U.S. PATENT DOCUMENTS

| | | | | |
|---|---|---|---|---|
| 7,353,912 | B2 * | 4/2008 | Reuter | B66B 5/0031 187/249 |
| 7,448,471 | B2 * | 11/2008 | Nuebling | B66B 5/0031 187/249 |
| 8,136,635 | B2 * | 3/2012 | Christy | B66B 9/00 187/249 |
| 8,424,651 | B2 * | 4/2013 | Brand | B66B 1/2466 187/249 |
| 8,434,599 | B2 * | 5/2013 | Wang | B66B 5/0031 187/249 |
| 8,602,168 | B2 * | 12/2013 | Tschuppert | B66B 9/00 187/249 |
| 2010/0213012 | A1 | 8/2010 | Wang et al. | |

OTHER PUBLICATIONS

International Search Report Issued Aug. 9, 2011 in PCT/JP11/058905 Filed Apr. 8, 2011.

* cited by examiner

MULTI-CAR ELEVATOR AND CONTROLLING METHOD THEREFOR

TECHNICAL FIELD

The present invention relates to a multi-car elevator in which a plurality of cars are disposed inside a shared hoistway and to a controlling method therefor.

BACKGROUND ART

In conventional multi-car elevators, when two adjacent cars travel in a like direction, traveling speed control is performed such that a traveling start time of a trailing car is delayed relative to a traveling start time of a leading car in order to prevent collision between the cars. Here, the distance separating the leading car and the trailing car is controlled such that if the leading car stops urgently, the trailing car will not collide with the leading car even if stopped using a normal stopping operation (see Patent Literature 1, for example).

CITATION LIST

Patent Literature

[Patent Literature 1]
Japanese Patent Publication No. 2010-538948 (Gazette)

SUMMARY OF THE INVENTION

Problem to be Solved by the Invention

However, in conventional multi-car elevators such as that described above, when the leading car stops urgently, if the trailing car does not switch over to the normal stopping operation or the speed of the trailing car increases for a moment due to an anomaly such as running away of a controlling apparatus, for example, then there has been a risk that the trailing car will not be able to stop so as to leave a distance that is greater than or equal to a predetermined value from the leading car, even if stopped urgently upon detecting the anomaly.

The present invention aims to solve the above problems and an object of the present invention is to provide a multi-car elevator that can stop a trailing car so as to ensure a safe distance from a leading car more reliably when the leading car stops suddenly, and to provide a controlling method therefor.

Means for Solving the Problem

In order to achieve the above object, according to one aspect of the present invention, there is provided a multi-car elevator including: a plurality of cars that are disposed inside a shared hoistway; a plurality of driving apparatuses that respectively raise and lower the cars independently; an elevator controlling apparatus that controls the driving apparatus; and a plurality of braking apparatuses that brake the cars, wherein, when two adjacent cars travel in a like direction, the elevator controlling apparatus: determines a shortest stopping position that is a stopping position at which a leading car stops in a shortest stopping distance from its present position; determines an estimated stopping position that is a stopping position of a trailing car if the trailing car is stopped urgently when the trailing car deviates from a speed change path for stopping using decelerating control by the elevator controlling apparatus from its present position and approaches the leading car; and controls a separating distance between the leading car and the trailing car such that the estimated stopping position is before the shortest stopping position.

According to another aspect of the present invention, there is provided a multi-car elevator including: a plurality of cars that are disposed inside a shared hoistway; a plurality of driving apparatuses that respectively raise and lower the cars independently; an elevator controlling apparatus that controls the driving apparatus; and a plurality of braking apparatuses that brake the cars, wherein, when two adjacent cars travel in a like direction, the elevator controlling apparatus: determines an estimated stopping position that is a stopping position at which a trailing car can be stopped using decelerating control by the elevator controlling apparatus from its present position; and controls a separating distance between a leading car and the trailing car such that the estimated stopping position is before a present position of the leading car by greater than or equal to a threshold distance.

According to yet another aspect of the present invention, there is provided a multi-car elevator controlling method, being a controlling method when two adjacent cars travel in a like direction, wherein the multi-car elevator controlling method includes steps of: determining a shortest stopping position that is a stopping position at which a leading car may stop in a shortest stopping distance from its present position; determining an estimated stopping position that is a stopping position of a trailing car if the trailing car is stopped urgently when the trailing car deviates from a speed change path for stopping using decelerating control by a elevator controlling apparatus from its present position and approaches the leading car; and controlling a separating distance between the leading car and the trailing car such that the estimated stopping position is before the shortest stopping position.

According to yet another aspect of the present invention, there is provided a multi-car elevator controlling method, being a controlling method when two adjacent cars travel in a like direction, wherein the multi-car elevator controlling method includes steps of: determining an estimated stopping position that is a stopping position at which a trailing car can be stopped using decelerating control by an elevator controlling apparatus from its present position; and controlling a separating distance between a leading car and the trailing car such that the estimated stopping position is before a present position of the leading car by greater than or equal to a threshold distance.

Effects of the Invention

Because the multi-car elevator, and the controlling method therefor, according to the present invention determines a shortest stopping position that is a stopping position at which a leading car stops in a shortest stopping distance from its present position, determines an estimated stopping position that is a stopping position of a trailing car if the trailing car is stopped urgently when the trailing car deviates from a speed change path for stopping using decelerating control by the elevator controlling apparatus from its present position and approaches the leading car, and controls a separating distance between the leading car and the trailing car such that the estimated stopping position is before the shortest stopping position, when two adjacent cars travel in a like direction, even if the trailing car deviates from the speed change path for stopping using decelerating control by the elevator controlling apparatus and approaches the leading car when the leading car stops suddenly, the trailing car can be stopped so as to ensure a safe distance from the leading car more reliably.

Because the multi-car elevator, and the controlling method therefor, according to the present invention determines an estimated stopping position that is a stopping position at which a trailing car can be stopped using decelerating control by the elevator controlling apparatus from its present position; and controls a separating distance between a leading car and the trailing car such that the estimated stopping position is before a present position of the leading car, when two adjacent cars travel in a like direction, even if the trailing car deviates from the speed change path for stopping using decelerating control by the elevator controlling apparatus and approaches the leading car when the leading car stops suddenly, the trailing car can be stopped so as to ensure a safe distance from the leading car more reliably if the trailing car is immediately stopped urgently at a deceleration rate that is equal to the deceleration rate of the leading car.

DESCRIPTION OF EMBODIMENTS

A preferred embodiment of the present invention will now be explained with reference to the drawings.

Embodiment 1

Figure 1:
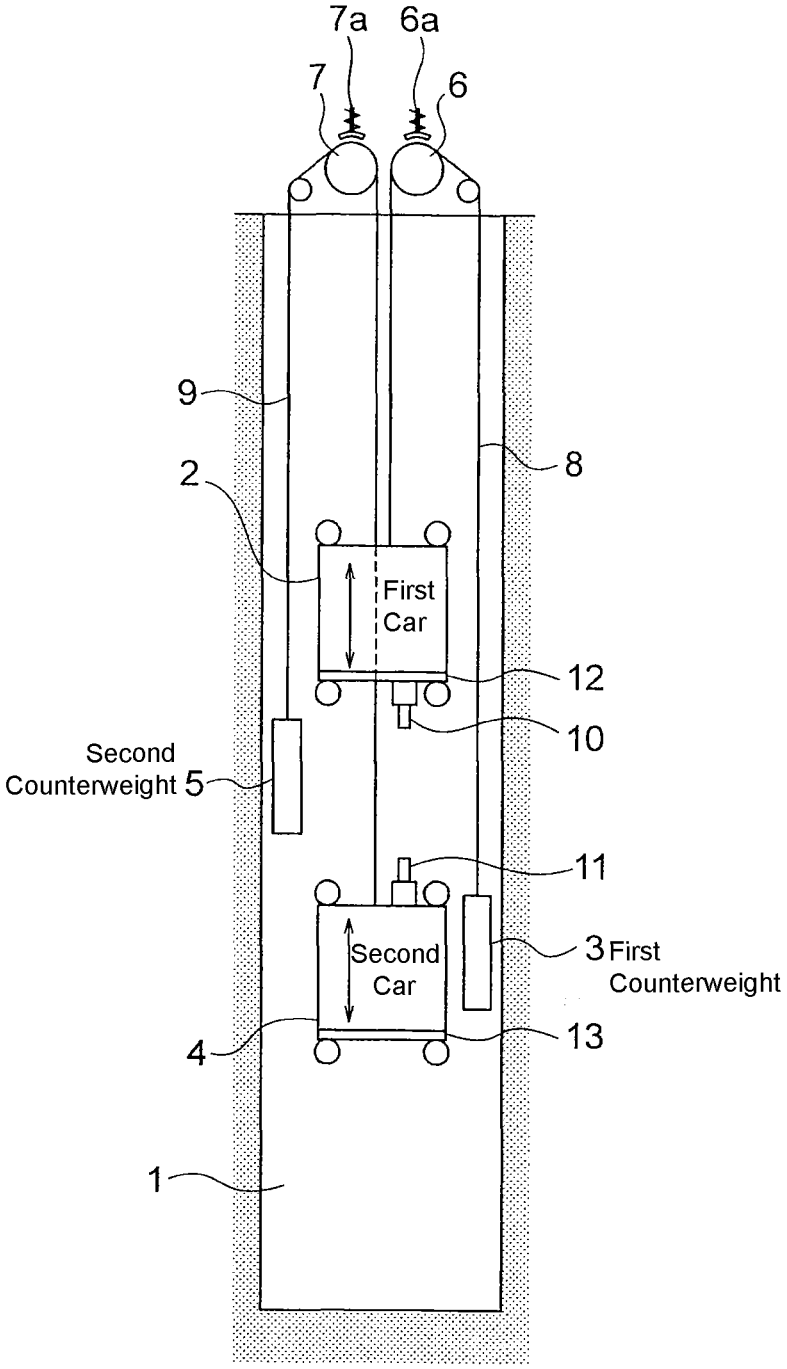
FIG. 1 is a configuration diagram that shows a multi-car elevator according to Embodiment 1 of the present invention.

FIG. 1 is a configuration diagram that shows a multi-car elevator according to Embodiment 1 of the present invention. In the figure, disposed inside a shared hoistway 1 are: a first car (an upper car) 2; a first counterweight 3 that corresponds to the first car 2; a second car (a lower car) 4; and a second counterweight 5 that corresponds to the second car 4. The first car 2 is disposed above (directly above) the second car 4.

A first driving apparatus (a first hoisting machine) 6 that raises and lowers the first car 2 and the first counterweight 3 and a second driving apparatus (a second hoisting machine) 7 that raises and lowers the second car 4 and the second counterweight 5 are installed in an upper portion of the hoistway 1. The first and second cars 2 and 4 are raised and lowered inside the hoistway 1 independently from each other by the driving apparatuses 6 and 7.

The first driving apparatus 6 has: a first driving sheave; a first motor that rotates the first driving sheave; and a first hoisting machine brake 6*a* that is a braking apparatus that brakes rotation of the first driving sheave. The second driving apparatus 7 has: a second driving sheave; a second motor that rotates the second driving sheave; and a second hoisting machine brake 7*a* that is a braking apparatus that brakes rotation of the second driving sheave.

A first suspending means 8 is wound around the driving sheave of the first driving apparatus 6. The first car 2 and the first counterweight 3 are suspended inside the hoistway 1 by the first suspending means 8. A second suspending means 9 is wound around the driving sheave of the second driving apparatus 7. The second car 4 and the second counterweight 5 are suspended inside the hoistway 1 by the second suspending means 9.

A plurality of ropes or a plurality of belts, for example, can be used as the first suspending means 8. In this example, the first car 2 and the first counterweight 3 are suspended using a one-to-one (1:1) roping method.

A plurality of ropes or a plurality of belts, for example, can be used as the second suspending means 9. In this example, the second car 4 and the second counterweight 5 are suspended using a one-to-one (1:1) roping method.

A first buffering apparatus (an upper car buffer) 10 is mounted onto a lower portion of the first car 2. A second buffering apparatus (a lower car buffer) 11 is mounted onto an upper portion of the second car 4.

A first safety device 12 that is a braking apparatus that engages with a car guide rail to make the first car 2 perform an emergency stop is mounted onto the first car 2. A second safety device 13 that is a braking apparatus that engages with a car guide rail to make the second car 4 perform an emergency stop is mounted onto the second car 4.

Figure 2:
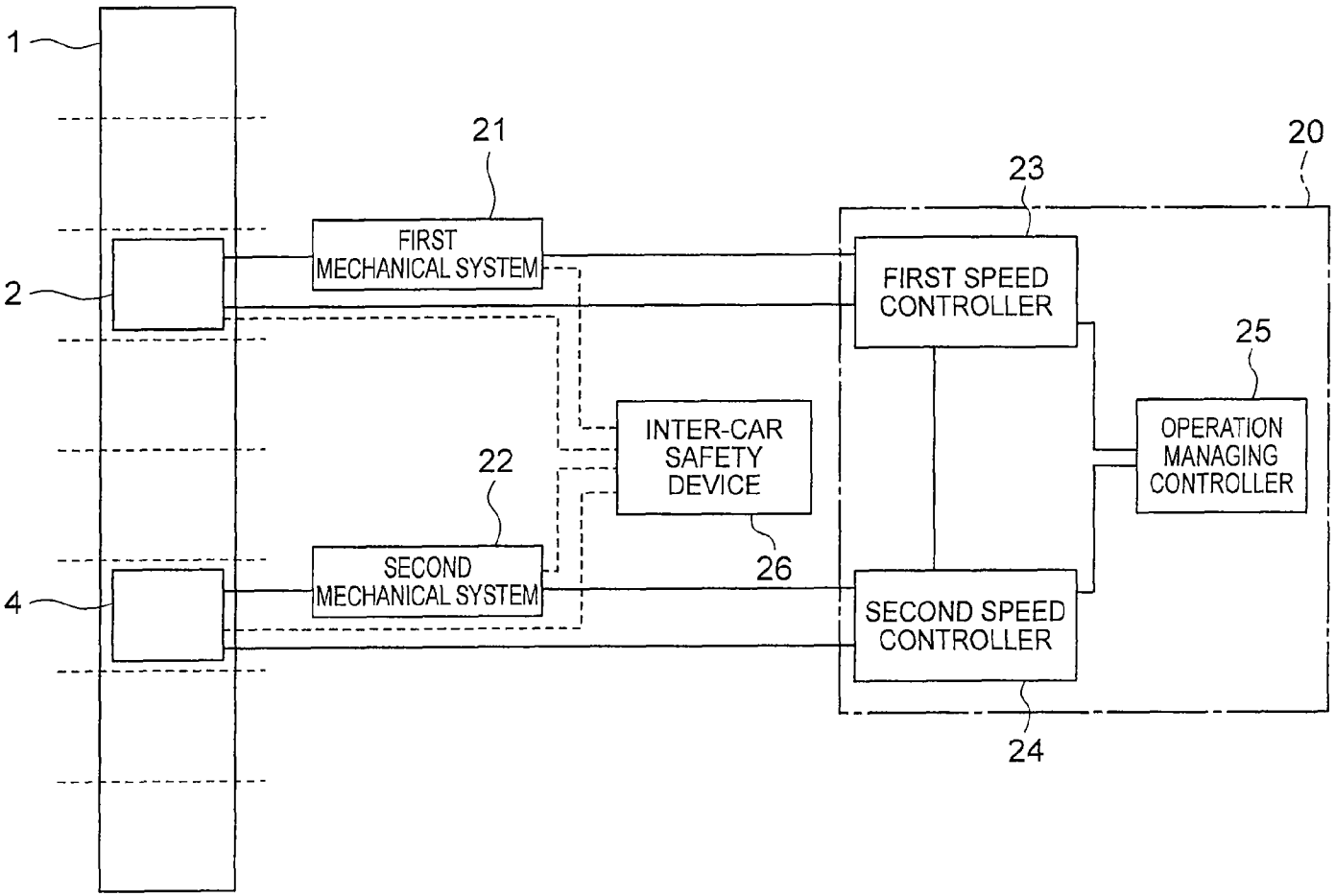
FIG. 2 is a block diagram that shows a controlling system of the multi-car elevator in FIG. 1.

FIG. 2 is a block diagram that shows a controlling system of the multi-car elevator in FIG. 1. A first mechanical system 21 is a mechanical system that drives the first car 2, and includes: the first driving apparatus 6; the first suspending means 8; a rotation sensor that detects rotational speed of the driving sheave of the first driving apparatus 6; and a state sensor that detects a state of the first suspending means 8, etc.

A second mechanical system 22 is a mechanical system that drives the second car 4, and includes: the second driving apparatus 7; the second suspending means 9; a rotation sensor that detects rotational speed of the driving sheave of the second driving apparatus 7; and a state sensor that detects a state of the second suspending means 9, etc.

A first speed controller 23 that controls traveling speed of the first car 2 is connected to the first mechanical system 21 and the first car 2. The first mechanical system 21 moves the first car 2 according to a traveling speed command value from the first speed controller 23.

The first mechanical system 21 sends state quantity information that relates to the movement of the first car 2, such as the position and speed of the first car 2, and the state of the first suspending means 8, for example, to the first speed controller 23. The first car 2 sends information that relates to a state of doors of the first car 2 to the first speed controller 23.

A second speed controller 24 that controls traveling speed of the second car 4 is connected to the second mechanical system 22 and the second car 4. The second mechanical system 22 moves the second car 4 according to a traveling speed command value from the second speed controller 24.

The second mechanical system 22 sends state quantity information that relates to the movement of the second car 4, such as the position and speed of the second car 4, and the state of the second suspending means 9, for example, to the second speed controller 24. The second car 4 sends information that relates to a state of doors of the second car 4 to the second speed controller 24.

An operation managing controller 25 is connected to the first and second speed controllers 23 and 24. The operation managing controller 25 outputs an operating command for the first car 2 to the first speed controller 23, and also outputs an operating command for the second car 4 to the second speed controller 24. An elevator controlling apparatus 20 includes the first and second speed controllers 23 and 24 and the operation managing controller 25.

The first speed controller 23 uses the information that is sent from the first car 2 and the first mechanical system 21 to determine the position and speed of the first car 2, and the first car state, and controls the traveling speed of the first car 2 by means of the first mechanical system 21 in accordance with the operating command from the operation managing controller 25.

The second speed controller 24 uses the information that is sent from the second car 4 and the second mechanical system 22 to determine the position and speed of the second car 4, and the second car state, and controls the traveling speed of the second car 2 by means of the second mechanical system 22 in accordance with the operating command from the operation managing controller 25.

The first and second speed controllers 23 and 24 are connected to each other and can recognize each other's car position and speed.

In addition, if anomalous approach of the first and second cars 2 and 4 is detected, the first and second speed controllers 23 and 24 can output decelerating commands, and perform control to avoid a collision. In such cases, it is desirable to decelerate at a deceleration rate used during normal running, but if it is an urgent stopping operation to avoid a collision, the decelerating command may also be at a deceleration rate that is higher than during normal running. Furthermore, if the cars 2 and 4 stop at positions that are not aligned with normal floor alignment positions, it is necessary to move the cars 2 and 4 to positions at which the passengers can alight to landings after stopping.

Methods for outputting the decelerating command include decelerating, or decelerating and stopping, only the trailing car. These have the merit of enabling movement of the leading car to be continued. Another method is to decelerate and stop both the leading car and the trailing car. This has the merit of enabling the output circuit of the operating command to be formed using a simple configuration.

If the first and second speed controllers 23 and 24 detect an anomalous approach of the first and second cars 2 and 4 when they are traveling in a like direction, then collision avoidance can also be achieved by increasing the leading car speed.

The first and second speed controllers 23 and 24 each have an independent computer. The operation managing controller 25 also has a computer that is independent from the first and second speed controllers 23 and 24.

An inter-car safety device 26 is connected to the first and second cars 2 and 4 and the first and second mechanical systems 21 and 22 in a system that is separate from the first and second speed controllers 23 and 24. The inter-car safety device 26 monitors for the presence or absence of an anomalous state that might lead to the cars 2 and 4 colliding with each other, such as anomalous approach of the first and second cars 2 and 4, or an anomaly in the state of suspension, for example.

The inter-car safety device 26 detects the anomalous state based on state quantity information that relates to movement of the first and second cars 2 and 4 that is sent from the cars 2 and 4 and the mechanical systems 21 and 22. In addition, when an anomalous state is detected, the inter-car safety device 26 outputs an operating command to at least one braking apparatus that is included in the cars 2 and 4 and the mechanical systems 21 and 22.

Furthermore, the inter-car safety device 26 has a computer that is independent from the speed controllers 23 and 24 and the operation managing controller 25. The inter-car safety device 26 is also able to perform acquisition of the state quantity information and outputting of the operating command to the braking apparatus independently without depending on the speed controllers 23 and 24 and the operation managing controller 25.

In this example, if the inter-car safety device 26 detects an anomalous approach of the first and second cars 2 and 4 when traveling in a like direction, then collision is avoided by decelerating or stopping the trailing car. For this reason, the inter-car safety device 26 outputs the operating command to at least one braking apparatus that is included in the trailing car or in the mechanical system that corresponds to the trailing car. Thus, if the leading car is functioning normally, movement of the leading car can be continued.

Next, details of the monitoring operation by the speed controllers 23 and 24 and the inter-car safety device 26 will be explained. In order to facilitate understanding, a case in which the first car 2 is traveling upward (away from the second car 4) as the leading car and the second car 4 is traveling upward (toward the first car 4) as the trailing car will be explained below.

The second speed controller 24, which corresponds to the trailing car, and the inter-car safety device 26, determine the position and speed of the first car 2 and the position and speed of the second car 4 based on the acquired state quantity information.

The second speed controller 24 and the inter-car safety device 26 subsequently determine the shortest stopping position which is the stopping position when the first car 2 stops in the shortest stopping distance from the present position. The shortest stopping distance refers to the stopping distance when the braking apparatus is operated that generates the highest deceleration rate in the first car 2 among the braking apparatuses that act directly on the first car 2 (the safety devices 12, etc.), and the braking apparatuses that act on the first mechanical system 21 (the hoisting machine brake **6*a* of the first driving apparatus 6, a main rope brake, the safety device that acts on the first counterweight 3**, etc.).

However, if evaluation of the highest deceleration rate is difficult, then the highest deceleration rate that is generated by the first car 2 can be assumed to be infinite, and the present position of the first car 2 can also be determined as the shortest stopping position.

Next, the second speed controller 24 and the inter-car safety device 26 determine the estimated stopping position of the ascending second car 4.

Now, when consideration is given to passenger burden or confinement, it is desirable to attempt to avoid collision by operational control rather than by stopping the second car 4 urgently using braking apparatuses (normal decelerating control is particularly desirable).

In other words, if an anomalous approach is detected, collision avoidance is first attempted using decelerating control by the second speed controller 24. Thus, if collision cannot be avoided using decelerating control by the second speed controller 24 due to some anomaly such as running away of the second speed controller 24, for example, then it is desirable for the second car 4 to be stopped urgently by the inter-car safety device 26 to avoid collision.

Detecting that the approach speed of the second car 4 toward the first car 2 is higher than a predetermined value, detecting breakage of the second suspending means 9, and detecting a reduction in traction capacity due to abrasion of the second suspending means 9 are conceivable as anomalous states for avoiding collision using the inter-car safety device 26.

From the above, the estimated stopping position of the second car 4 is determined on the assumption that the second car 4 stops at the closest position to the first car 2 when collision cannot be avoided using decelerating control by the second speed controller 24 (normal decelerating control, for example) and the second car 4 is urgently braked by the inter-car safety device 26.

The estimated stopping position of the second car 4 is calculated based on at least one parameter that is selected from among: speed, direction, load, acceleration and deceleration rates, jerk of the second car 4; braking characteristics of the braking apparatuses; traction capacity; errors in sensors that detect the traveling state of the second car 4; time that is required to communicate the information that is obtained by the sensors; and time that is required to determine the state of the second car 4.

In addition, the estimated stopping position of the second car 4 changes depending on the position and speed of the second car 4. In particular, the higher the speed of the second car 4, the closer the approach to the first car 2.

In answer to that, the second speed controller 24 and the inter-car safety device 26 determine the estimated stopping position of the second car 4 by disposing a limitation such that the estimated stopping position of the second car 4 is not a position that is further away from the second car 4 than the shortest stopping position of the first car 2, or a limitation so as not to be a position that is further away from the second car 4 than a position that is closer to the second car 4 than the shortest stopping position of the first car 2 by a predetermined threshold distance.

The inter-car safety device 26 determines the shortest stopping position and the estimated stopping position and monitors the separating distance independently from the elevator controlling apparatus 20.

Now, if Plst(T) is the shortest stopping position of the first car 2 at time T, Ptst(T) is the estimated stopping position of the second car 4, and Dth is the predetermined threshold distance, then the above explanation expressed as a formula is given by:

$$Plst(T)-Ptst(T)\geq Dth \quad (1)$$

Here, Dth is greater than or equal to 0, and position increases in the direction of travel.

Because Plst(T) and Ptst(T) change with time, the second speed controller 24 and the inter-car safety device 26 perform collision monitoring that uses Expression (1) consecutively or periodically, and dynamically and constantly.

The second speed controller 24 performs speed control on the second car 4 such that detection of anomalous approach by the second speed controller 24 itself or by the inter-car safety device 26 does not arise.

Figure 3:
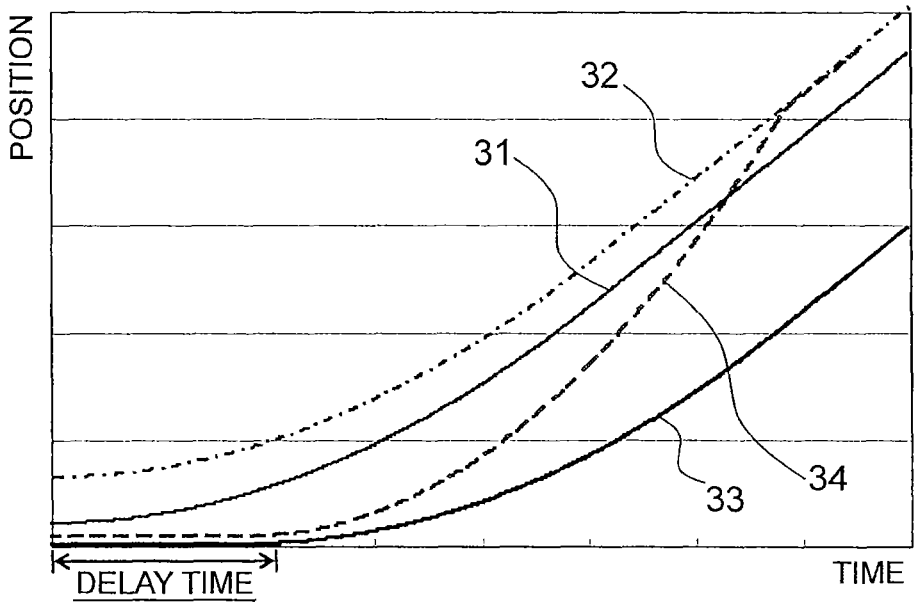
FIG. 3 is a graph that shows a first example of a shortest stopping position of a first car and an estimated stopping position of a second car.
Figure 4:
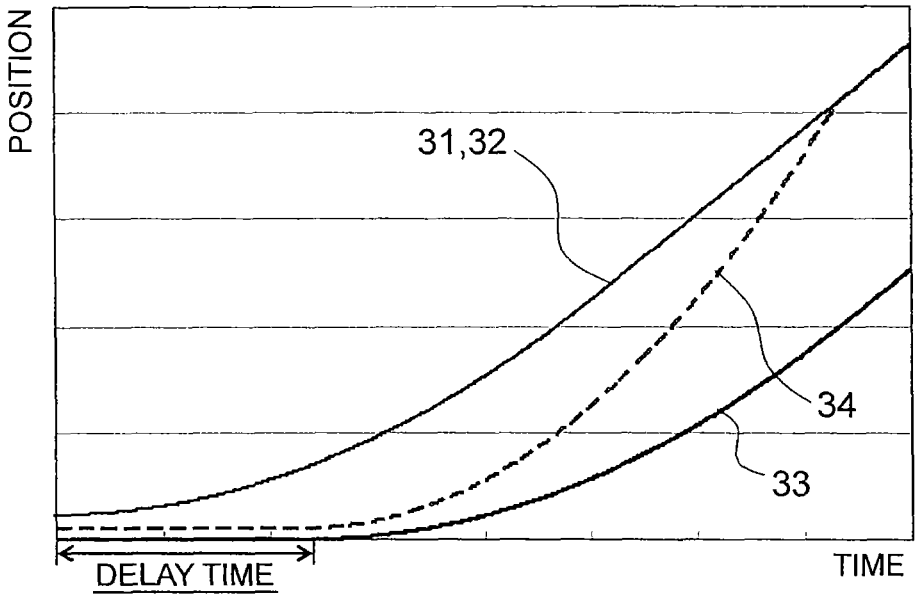
FIG. 4 is a graph that shows a second example of a shortest stopping position of a first car and an estimated stopping position of a second car.

Now, paths of car position when the first and second cars 2 and 4 start traveling from positions that are adjacent to each other are shown in FIGS. 3 and 4. In FIG. 3, the shortest stopping position of the first car 2 has been found using the highest deceleration rate that may arise in the first car 2. In FIG. 4, on the other hand, the shortest stopping position of the first car 2 has been found on the assumption that an infinite deceleration rate arises in the first car 2. In order to simplify the figure, the above-mentioned threshold distance Dth is plotted as 0 in FIGS. 3 and 4.

In FIGS. 3 and 4, path 31 represents a path of a traveling position of the first car 2, path 32 represents a path of the shortest stopping position of the first car 2, path 33 represents a path of the traveling position of the second car 4, and path 34 represents a path of the estimated stopping position of the second car 4.

As described above, since the path 34 is a position before the path 32 by the threshold distance Dth, it is necessary for the second speed controller 24 to dispose a predetermined delay time between when the first car 2 starts traveling and when the second car 4 starts traveling.

A method for determining the delay time used by the second speed controller 24 will now be explained. The second speed controller 24 first determines the shortest stopping position Plst(T) of the first car 2 at time $0\leq T\leq Tl$, at which the first car 2 is traveling, by the method described above.

Next, the second speed controller 24 determines the estimated stopping position Ptst(T) of the second car 4 at time $Td\leq T\leq Tt$, at which the second car 4 is traveling, by the method described above. The second speed controller 24 subsequently determines a Td for which the following conditions are satisfied:

$$Plst(T)-Ptst(T)\geq Dth \quad (2)$$

Here, Dth is greater than or equal to 0, Td is less than or equal to T, which is less than or equal to Tt, and position increases in the direction of travel.

The Td that is determined in this manner becomes a delay time (a stand-by time) from when the first car 2 starts traveling until the second car 4 starts traveling.

Moreover, a similar or identical monitoring operation can also be performed when the first and second cars 2 and 4 are traveling downward, and in that case the first speed controller 23 performs the operation of the second speed controller 24 that is described above.

Thus, in the multi-car elevator according to Embodiment 1, the shortest stopping position, which is the stopping position at which the leading car stops in the shortest stopping distance from its present position, is determined. The estimated stopping position, which is the stopping position of the trailing car if the trailing car is stopped urgently when the trailing car deviates from a speed change path for stopping using decelerating control by the elevator controlling apparatus 20 from its present position and approaches the leading car, is also determined. Then, the separating distance between the leading car and the trailing car is controlled such that the estimated stopping position is before the shortest stopping position. Thus, even if the trailing car deviates from a speed change path for stopping by normal decelerating control and approaches the leading car when the leading car stops suddenly, the trailing car can be stopped so as to ensure a safe distance from the leading car more reliably.

Because the trailing car is stopped urgently if a collision cannot be avoided using decelerating control by the elevator controlling apparatus 20, reductions in serviceability such as passenger confinement, for example, can be prevented.

In addition, because the inter-car safety device 26 determines the shortest stopping position of the leading car and the estimated stopping position of the trailing car and monitors the separating distance independently from the elevator controlling apparatus 20, the separating distance can be monitored, and collision between the cars 2 and 4 avoided, even during failure of the elevator controlling apparatus 20.

Furthermore, because the elevator controlling apparatus 20 assumes the leading car stops at an infinite deceleration rate if evaluation of the highest deceleration rate is difficult, and determines the present position of the leading car as the shortest stopping position, the separating distance can be sufficiently ensured using simple control.

Moreover, if the present position of the leading car is determined as the shortest stopping position, then the position at which the trailing car can stop using decelerating control by the elevator controlling apparatus 20 from its present position may also be determined as the estimated stopping position, and the separating distance between the leading car and the trailing car may be controlled such that the estimated stopping position is before the present position of the leading car by greater than or equal to the threshold distance.

In that case, even if the trailing car deviates from a speed change path for stopping by decelerating control and approaches the leading car when the leading car stops suddenly, the trailing car can be stopped so as to ensure a safe distance from the leading car more reliably if the trailing car is immediately stopped urgently at a deceleration rate that is equal to the deceleration rate of the leading car.

Furthermore, the roping method is not limited to a one-to-one (1:1) roping method, and may also be a two-to-one (2:1) roping method, for example.

In addition, different roping methods for each car may also be combined.

Still furthermore, two cars 2 and 4 were used in the above example, but three or more cars may also be disposed inside the shared hoistway 1.

The invention claimed is:

1. A multi-car elevator comprising:

a plurality of cars that are disposed inside a shared hoistway;

a plurality of driving apparatuses that respectively raise and lower the cars independently;

an elevator controlling apparatus that controls the driving apparatus;

a plurality of braking apparatuses that brake the cars; and an inter-car safety device that monitors for an anomalous state that could lead to a collision between the plurality of cars, wherein, when two adjacent cars travel in a like direction, the elevator controlling apparatus:

determines a shortest stopping position that is a stopping position at which a leading car stops in a shortest stopping distance from its present position;

determines an estimated stopping position that is a stopping position of a trailing car if the trailing car is stopped urgently when the trailing car deviates from a speed change path for stopping using decelerating control by the elevator controlling apparatus from its present position and approaches the leading car; and controls a separating distance between the leading car and the trailing car such that the estimated stopping position is before the shortest stopping position, and wherein, when the two adjacent cars travel in the like direction, the inter-car safety device:

stops the trailing car urgently if a collision cannot be avoided using decelerating control by the elevator controlling apparatus; and determines the shortest stopping position of the leading car and the estimated stopping position of the trailing car and monitors the separating distance independently from the elevator controlling apparatus.

2. A multi-car elevator according to claim 1, wherein the elevator controlling apparatus controls the separating distance by disposing a predetermined delay time between when the leading car starts traveling and when the trailing car starts traveling.

3. A multi-car elevator according to claim 1, wherein the elevator controlling apparatus increases speed of the leading car, or reduces the speed of the trailing car, or stops the trailing car, or stops the leading car and the trailing car, if an anomalous approach of the trailing car toward the leading car is detected.

4. A multi-car elevator according to claim 1, wherein the elevator controlling apparatus assumes that the leading car stops at an infinite deceleration rate and determines the present position of the leading car as the shortest stopping position.

5. A multi-car elevator controlling method, being a multi-car elevator controlling method when two adjacent cars travel in a like direction, wherein the multi-car elevator controlling method comprises steps of:

determining a shortest stopping position that is a stopping position at which a leading car stops in a shortest stopping distance from its present position;

determining an estimated stopping position that is a stopping position of a trailing car if the trailing car is stopped urgently when the trailing car deviates from a speed change path for stopping using decelerating control by a elevator controlling apparatus from its present position and approaches the leading car;

controlling a separating distance between the leading car and the trailing car such that the estimated stopping position is before the shortest stopping position;

determining the shortest stopping position of the leading car and the estimated stopping position of the trailing car and monitoring the separating distance independently from the elevator controlling apparatus by an inter-car safety device; and stopping the trailing car urgently by the inter-car safety device if it is determined that a collision cannot be avoided using decelerating control by the elevator controlling apparatus.

6. A multi-car elevator controlling method according to claim 5, wherein the separating distance satisfies:

$$Plst(T)-Ptst(T)\geq Dth$$

where Plst(T) is the shortest stopping position of the leading car at a predetermined time T, Ptst(T) is the estimated stopping position of the trailing car, Dth is a threshold distance that is greater than or equal to 0, and position increases in a direction of travel.

7. A multi-car elevator controlling method according to claim 5, wherein the separating distance is controlled by disposing a predetermined delay time between when the leading car starts traveling and when the trailing car starts traveling.

* * * * *